US006899581B1

(12) United States Patent
Nokes

(10) Patent No.: US 6,899,581 B1
(45) Date of Patent: May 31, 2005

(54) WATER PADDLE FOR SURFACE AND UNDERWATER SWIMMING, SNORKELING AND WATER EXERCISES

(76) Inventor: Ronald W. Nokes, 3410-B W. 98th Ave., Westminster, CO (US) 80031

( * ) Notice: Subject to any disclaimer, the term of this patent is extended or adjusted under 35 U.S.C. 154(b) by 0 days.

(21) Appl. No.: 10/655,074

(22) Filed: Sep. 5, 2003

(51) Int. Cl.[7] ..... A63B 31/10
(52) U.S. Cl. ..... 441/58; 441/56
(58) Field of Search ..... 441/55–59; D21/806, D21/807; 434/254; 482/55

(56) References Cited

U.S. PATENT DOCUMENTS

| | | | | | |
|---|---|---|---|---|---|
| 183,045 | A | * | 10/1876 | Dunlop | 441/58 |
| 950,633 | A | * | 3/1910 | Eastman | 441/58 |
| 1,541,100 | A | * | 6/1925 | Barrett | 441/58 |
| 1,623,852 | A | * | 4/1927 | Pike | 441/58 |
| 2,017,463 | A | * | 10/1935 | Komadina | 441/58 |
| 2,313,979 | A | * | 3/1943 | Tuma | 441/58 |
| 2,810,138 | A | * | 10/1957 | Cochran | 441/58 |
| 3,328,812 | A | * | 7/1967 | Berthiot | 441/58 |
| 3,417,415 | A | * | 12/1968 | Kozak | 441/58 |
| 3,698,026 | A | * | 10/1972 | Buntin | 441/57 |
| D256,604 | S | * | 8/1980 | Arzoian | D21/807 |
| D286,904 | S | * | 11/1986 | Kim | D21/807 |
| 5,304,080 | A | * | 4/1994 | Dilger | 441/58 |
| D397,187 | S | * | 8/1998 | Reeder | D21/807 |

FOREIGN PATENT DOCUMENTS

| | | | | |
|---|---|---|---|---|
| FR | 0528934 | * | 11/1921 | 441 56 |
| FR | 0541804 | * | 8/1922 | 441 58 |
| FR | 0746394 | * | 5/1933 | 441 56 |
| FR | 1248039 | * | 10/1960 | 441 58 |
| GB | 0003622 | * | 12/1907 | 441 59 |
| SU | 1583115 A | * | 8/1990 | A63B 31/08 |
| SU | 1718992 A1 | * | 3/1992 | A63B 31/02 |

* cited by examiner

*Primary Examiner*—S. Joseph Morano
*Assistant Examiner*—Ajay Vasudeva
(74) *Attorney, Agent, or Firm*—Edwin H. Crabtree; Ramon L. Pizarro; Donald W. Margolis

(57) ABSTRACT

A water paddle used for surface and underwater swimming, snorkeling, water aerobics and other water exercises. The water paddle includes a hand held, lightweight, flexible plastic, hydrodynamic paddle disk. A front of the paddle disk is flat or concave in shape for increasing or decreasing water resistance when moving the paddle in the water. Also, the paddle disk has a minimal thickness of ⅛ inch or less for allowing the flexing of the disk. An adjustable strap is received through a pair of parallel strap slots in the disk. The adjustable hand strap allows a swimmer to adjust his or her hand at various positions on the back of the paddle disk. The hand can be adjusted for allowing the disk to cover the fingers and palm of the hand in a first position. Also, the hand can be moved upwardly allowing the fingers to extend beyond the upper edge if need be in a second position and reduce pressure against the wrist of the swimmer.

13 Claims, 1 Drawing Sheet

WATER PADDLE FOR SURFACE AND UNDERWATER SWIMMING, SNORKELING AND WATER EXERCISES

BACKGROUND OF THE INVENTION (a) Field of the Invention

This invention relates to the swimming devices, swimming paddles and swimming fins and more particularly, but not by way of limitation, to a water paddle used for surface and underwater swimming, snorkeling, water aerobics and other water exercises.

(b) Discussion of Prior Art

Heretofore, there have been a variety of different types of swim paddles, hand swimming devices and swimming fins. In U.S. Pat. No. 1,541,100 to Barrett, U.S. Pat. No. 1,655,762 to Englehart and U.S. Pat. No. 5,304,080 to Dilger, three different types of swim paddles are illustrated having hand, finger and wrist straps for holding a hand next to the back of a paddle. These type of paddles are designed to be folded for changing water resistance during a crawl stroke when swimming. In U.S. Pat. No. 5,376,036 to Hull, a pull paddle is disclosed for swim training. The pull paddle includes a wrist detent along a center line of the paddle. Tubing grips are used for holding the wrist and one or more fingers next to the back of the paddle. In U.S. Pat. No. 3,922,740 to Potter, a hand swim fin is illustrated having a hand cover with clamps. The hand cover with clamps is used for holding the hand next to the back of a flat paddle. In U.S. Pat. Re. 28,855 to Montrella, a swim training paddle is described for training swimmers. The paddle includes tubing stretched between openings in the paddle. The tubing is used for holding fingers and the wrist next to the back of the paddle.

None of the above mentioned prior art patents specifically disclose the unique features, structure and function of the subject water paddle described herein.

SUMMARY OF THE INVENTION

In view of the foregoing, it is a primary objective of the water paddle is to provide a hand held, lightweight, flexible, plastic paddle disk. The disk can be round or any other angular configuration. A front of the paddle disk is flat or concave in shape for increasing or decreasing water resistance when moving the paddle through the water and for providing a comfortable shape for the hand to rest against. The water paddle is easily adaptable for surface and underwater swimming, snorkeling, water aerobics and other water exercises. Also, a pair of water paddles are both identical to each other, and therefore interchangeable for either a left hand or a right hand.

Another object of the invention is the paddle disk has minimal thickness for allowing the flexing of the disk by the hand to increase the curvature and add another dimension for changing the water resistance against the paddle disk during a swimming or exercise stroke. Also, the paddle disk is designed for fingers of the hand to press against a top portion of the disk and a palm of the hand to press against a bottom portion of the disk with the back of the hand arching against a hand strap. This feature allows for the flexing and unflexing of the concave paddle disk. Further, the paddle disk provides a proper angle of the front of the disk face to increase pulling power when swimming and feathering the paddle disk during a return stroke.

A further object on the invention is the paddle disk design is hydrodynamic in all directions for supporting stroke movement in all directions as opposed to other paddle designs that are not fully hydrodynamic and not suitable for movement in all directions.

Yet another object of the invention is to provide a water paddle having a paddle disk diameter in a range of 4 to 12 inches and greater for fitting a child's hand or an adult hand. Also, the paddle disk can be larger than an adult hand for increasing water resistance.

Still another object of the paddle disk is the use of an adjustable hand strap received through a pair of parallel strap slots in the disk. The adjustable hand strap allows a swimmer to adjust his or her hand in more than one different position on the back of the paddle disk. The hand can be adjusted for allowing the palm of the hand to be placed next to a lower edge of the disk or the hand can be moved upwardly incrementally through a number of positions so that the tips of the fingers can touch or extend past an edge of an upper portion of the disk. Adjustments can continue to move the palm toward the center of the disk by rotating the disk 180 degrees and moving the hand strap back toward the edge of the upper portion of the disk. As the palm is moved toward the center of the disk, the disk covers more and more of the wrist and provides support to the wrist when stroking. With the palm at the center of the disk, the disk can be turned 90 degrees to the length of the arm and stroking can be done back and forth perpendicular to the swimmer's body with the plane of the disk parallel to the length of the body.

Another object of the invention is the adjustable hand strap has a width in a range of ½ to 2 inches. The width of the strap is designed for comfort against the back of the hand, which may experience considerable pressure against the strap when pulling the paddle backwards in the water.

The water paddle includes a hand held, lightweight, round, flexible plastic, hydrodynamic paddle disk. A front of the paddle disk is flat or it can be concave in shape for affecting resistance when moving the paddle in the water. Also, the paddle disk has a minimal thickness of ⅛ inch or less for allowing the flexing of the disk. An adjustable strap is received through a pair of parallel strap slots in the disk. The adjustable hand strap allows a swimmer to adjust his or her hand at various positions on the back of the paddle disk. The hand can be adjusted for allowing the disk to cover the fingers and palm of the hand. Also, the hand can be moved upwardly on the disk so that the disk covers the wrist and reduces pressure against the wrist when stroking. In the extreme position of the hand with the palm near the center of the disk, the disk can be rotated 90 degrees for use with arm movement perpendicular to the swimmer's body.

These and other objects of the present invention will become apparent to those familiar with various types water paddles, swimming fins and similar swimming devices when reviewing the following detailed description, showing novel construction, combination, and elements as herein described, and more particularly defined by the claims, it being understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
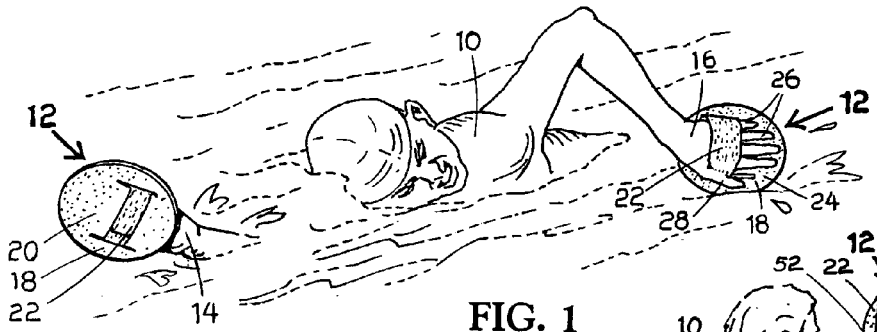
FIG. 1 is a perspective view of a swimmer using a pair of the subject water paddles on both hands when swimming a free style stroke.

In FIG. 1, a perspective view of a swimmer 10 is shown using a pair of the subject water paddles. The water paddles are shown in the drawings having general reference numeral 12. The water paddles 12 are interchangeable for both a right hand 14 and a left hand 16 of the swimmer 10. As mentioned above, the water paddles are hydrodynamic in all directions and can be used for surface and underground swimming, snorkeling, water aerobics and other water exercises.

The water paddle 12 includes a hand held, lightweight, flexible plastic, hydrodynamic paddle disk 18. The disk 18 preferably is round but can be shaped in various geometric configurations. The paddle disk 18 has a front 20, which is concave in shape for increasing or minimizing resistance when moving the paddle 12 in different directions through the water. The front 20 of the disk 18 can also be flat rather than concave in shape. The disk 18 typically has a diameter in a range of 4 to 12 inches and greater for fitting a child's hand or an adult hand. Also, the paddle disk 18 can be larger than an adult hand for increasing water resistance when exercising. Further, the paddle disk 18 has a minimal thickness of ⅛ inch or less for allowing the flexing of the disk by hand.

In this drawing, the concaved front 20 is shown with an adjustable hand strap 22 attached to the paddle disk 18 and on the right hand 14 of the swimmer 10. On the left hand 16 of the swimmer 10 is shown a back 24 of the paddle disk 18 with fingers 26 received between the back 24 of the paddle disk 18 and the hand strap 22. A thumb 28 is shown disposed next to a portion of the hand strap 22 resting in a "V" between the thumb 28 and the index finger 26.

Figure 2:
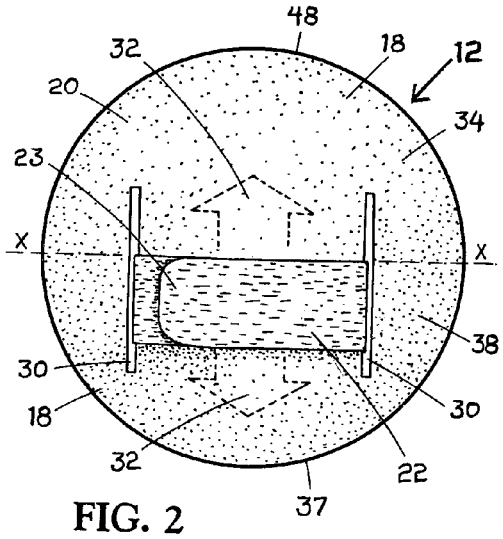
FIG. 2 is a front view of a front of the water paddle with an adjustable hand strap received through a pair of parallel strap slots in a paddle disk.
Figure 4:
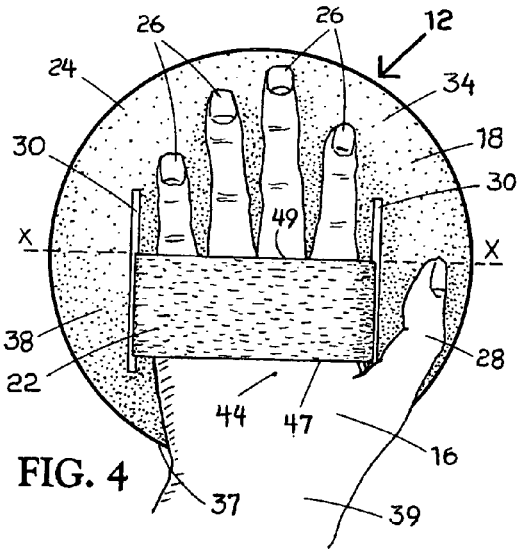
FIG. 4 is a rear view of the water paddle with the back of the swimmer's hand receiver against the hand strap as shown in FIG. 3.
Figure 5:
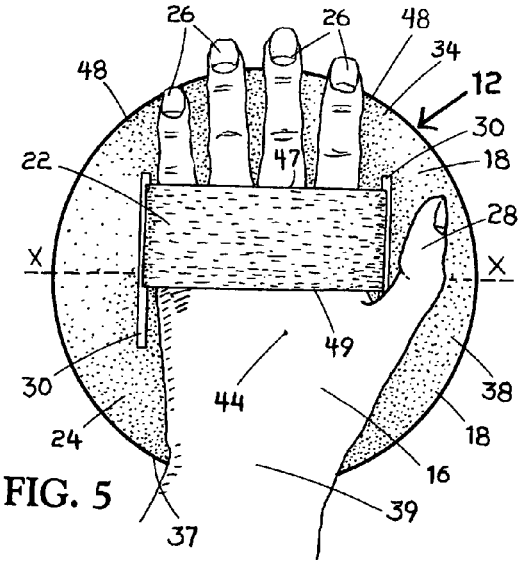
FIG. 5 is a rear view of the water paddle with the paddle disk rotated 180 degrees, as shown in FIG. 4, and the finger tips of the swimmer's hand extending over an edge of the upper portion of the back of the disk and in a second position on the disk. A portion of the swimmer's wrist is disposed against a lower portion of the paddle disk.

In FIG. 2, a front view of the water paddle 12 is shown with the adjustable hand strap 22 shown received through a pair of parallel hand strap slots 30 in the paddle disk 18. The hand strap 22 is adjustable in length for different size hands and is secured to the disk 18 using an end 23 of the strap 22 attached to a portion of the strap using hook and loop fasteners. The hand strap 22 is adjustable up and down and along the length of the parallel hand strap slots 30, as indicated by arrows 32. The length of the hand strap slots 30 is greater than a width of the hand straps 22. This feature allows a swimmer to adjust his or her hand at various positions on the back 24 of the paddle disk 18 as shown in FIGS. 4 and 5. The adjustable hand strap 22 can have a width in a range of ½ to 2 inches and is designed for comfort against the back of the hand. The back of the hand can experience considerable pressure against the strap 22 when pulling the paddle 10 backwards in the water. Therefore, a large width of the strap is important for ease and comfort against the back of hand. The disk 18 is shown having a horizontal center line X—X shown in dashed lines.

Figure 3:
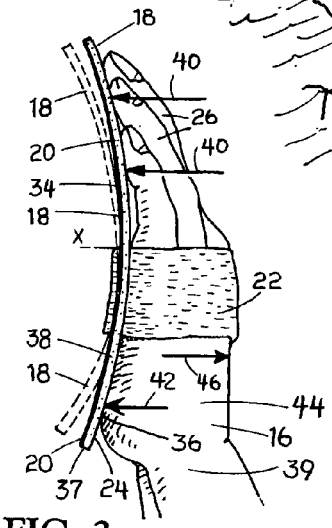
FIG. 3 is a side view of the water paddle with fingers of the swimmer's hand received between the hand strap and a back of the paddle disk and in a first position on the disk. The front of the hand is shown resting against an upper portion of the back of the disk. A palm of the hand is shown resting against a lower portion of the back of the disk.

In FIG. 3, a side view of the water paddle 10 is shown with fingers 26 of the swimmer's left hand 16 received inside between the hand strap 22 and the paddle disk 18. The hand 26 is shown resting against an upper portion 34, above the center line X—X, on the back 24 of the disk 18. A palm 36 of the hand 16 is shown resting against a lower portion 38, below the center line X—X, on the back of the disk.

As mentioned above, the paddle disk 18 is designed for the fingers 26 of either hand to press against the upper portion 34 of the disk 18, as indicated by arrows 40. Also, the palm 36 of the hand 16 can press against the lower portion 38 of the disk 18, as indicated by arrow 42. When this is done, a portion of the back 44 of the hand 16 arches against the hand strap 22, indicated by arrow 46. This feature allows for the flexing and unflexing of the concave paddle disk 12 thus providing for more efficient swimming during different types of swimming exercises. Further, the concave paddle disk 12 provides a proper angle of the front of the disk to increase pulling power when swimming and then feathering the disk during a return stroke.

In FIG. 4, a rear view of the water paddle 12 is shown with the back 44 of the swimmer's left hand 16 received against an inside of the hand strap 22, as shown in FIG. 3. The hand strap 22 is shown adjusted downwardly along the length of the parallel hand slots 30. The hand 16, when inserted next to a first side 47 of the strap 22, can be adjusted for allowing the back 24 of the disk 18 to cover the fingers 26 and palm 36 of the hand 16 in a first position. In this drawing, a second side 49 of the hand strap 22 is disposed along the center line X—X and the first side 47 is below the center line. As mentioned above, the diameter of the disk 18 can be sized for a child's hand, an adult hand and larger.

In FIG. 5, a rear view of the water paddle 12 is shown with the paddle disk 18 rotated 180 degrees from the disk 18 shown in FIG. 4. The first side 47 of the hand strap 22 is now above the centerline X—X. In this example, the fingertips of the fingers 26 of the swimmer's hand 16 are shown extending beyond an edge 48 of the upper portion of the disk 18 in a second position on the disk. A portion of a swimmer's wrist 50 is now protected by the lower portion 38 of the disk 18 for reducing water pressure thereagainst during a swimming or exercise stroke. It should be noted that as shown in FIGS. 4 and 5, the hand can be inserted from either sides 47 and 49 of the hand strap 22 and disposed next to the back 24 of the disk 18. Also and obviously, the hand strap 22 can be loosened in the hand strap slots 30 and moved up or down, as indicated by arrows 32, for various other hand adjustments on the paddle disk 18. Further, rather than rotate the disk 180 degrees, the hand strap 22 can be moved upwardly along the length of the hand strap slots 30 for allowing the hand 16 to rest in a similar position as shown in FIG. 5.

Figure 6:
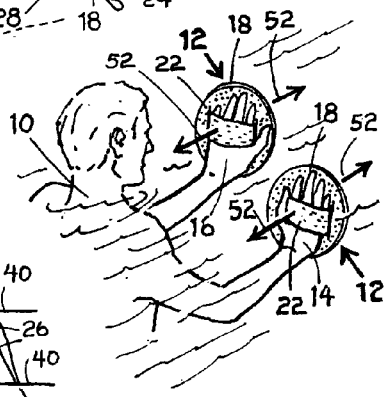
FIG. 6 is a perspective view of the swimmer's hands received between the hand straps and positioned on the back of the disks in a third position thereon. The swimmer's hands are held upwardly 90 degrees and perpendicular to a length of the arms. The plane of the disks is parallel to the body of the swimmer.

In FIG. 6, a perspective view of the swimmer's hands 14 and 16 are shown received between the hand straps 22 and disposed on the back 24 of the disk 18. The upper part of the palm 36 is disposed next to the centerline X—X of the disk 18 and in a third position thereon. The swimmers hands are held upwardly 90 degrees and perpendicular with a length of the swimmer's arms. The plane of the disks is parallel to the body of the swimmer. By centering the palms 36 on the disk, a maximum force can be applied by the hands 14 and 16 on the disks 18, as the water paddle 12 is moved back and forth in the water as indicated by arrows 52.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A water paddle used on the hand of a swimmer for surface and underwater swimming, snorkeling, water aerobics and other water exercises, the water paddle comprising:

a round, hand held, lightweight, round, flexible plastic, hydrodynamic paddle disk, said paddle disk having a front and a back, said disk having a diameter sufficient for covering the hand and fingers of the swimmer, the back of the disk adapted for receiving a palm of the swimmer's hand; and an adjustable hand strap, said adjustable strap received through a length of a pair of parallel hand strap slots in said disk, the length of said parallel hand strap slots greater than a width of said adjustable hand strap so that said hand strap can be adjusted up and down on said paddle disk for allowing the swimmer to adjust his or her hand at more than one position on the back of paddle disk, said hand strap received over a back of the swimmer's hand, said hand strap having a width sufficient to cover a portion of the back of the swimmer's hand;

whereby said adjustable hand strap has a first side and a second side, the first side adapted for receipt of the hand in a first position on said disk, the first side disposed below a center line of said disk, the second side disposed along the center line of said disk, the first position allowing said disk to cover the hand and fingers of the swimmer;

whereby when said disk is rotated 180 degrees, said adjustable hand strap has the second side adapted for receipt on the hand in a second position on said disk, in the second position the first side is disposed above the center line of said disk and the second side disposed along the center line of said disk, the second position allowing the fingers of the swimmer to grip an edge of an upper portion of said disk.

2. The water paddle as described in claim 1 wherein said paddle disk has a diameter in a range of 4 to 12 inches.

3. The water paddle as described in claim 1 wherein a portion of said adjustable strap is adapted for receipt in a "V" between the swimmer's thumb and index finger.

4. The water paddle as described in claim 1 wherein said adjustable strap has a width in a range of ½ to 2 inches for comfort when the swimmer's hand is arched against the back of said paddle disk.

5. The water paddle as described in claim 1 wherein said adjustable strap can be adjusted in a third position on said paddle disk for allowing an upper portion of the swimmer's palm to rest along the centerline of said paddle disk.

6. The water paddle as described in claim 1 wherein the front of said disk is concave and the back of said disk is convex.

7. A water paddle used on the hand of a swimmer for surface and underwater swimming, snorkeling, water aerobics and other water exercises, the water paddle comprising:

a round, hand held, lightweight, round, flexible plastic, hydrodynamic paddle disk, said paddle disk having a front and a back, the front of said disk is concave in shape and the back of said disk is convex in shape, said disk having a diameter sufficient for covering the hand and fingers of the swimmer, the back of the disk adapted for receiving a palm of the swimmer's hand; and an adjustable hand strap, said adjustable strap received through a length of a pair of parallel hand strap slots in said disk, the length of said parallel hand strap slots greater than a width of said adjustable hand strap so that said hand strap can be adjusted up and down on said paddle disk for allowing the swimmer to adjust his or her hand at more than one position on the back of paddle disk, said hand strap received over a back of the swimmer's hand, said hand strap having a width sufficient to cover a portion of the back of the swimmer's hand, a portion of said hand strap adapted for receipt in a "V" between the swimmer's thumb and index finger;

whereby said adjustable hand strap has a first side and a second side, the first side adapted for receipt of the hand in a first position on said disk, the first side disposed below a center line of said disk, the second side disposed along the center line of said disk, the first position allowing said disk to cover the hand and fingers of the swimmer;

whereby when said disk is rotated 180 degrees, said adjustable hand strap has the second side adapted for receipt on the hand in a second position on said disk, in the second position the first side is disposed above the center line of said disk and the second side disposed along the center line of said disk, the second position allowing the fingers of the swimmer to grip an edge of an upper portion of said disk.

8. The water paddle as described in claim 7 wherein said paddle disk has a diameter in a range of 4 to 12 inches.

9. The water paddle as described in claim 7 wherein said adjustable strap has a width in a range of ½ to 2 inches for comfort when the swimmer's hand is arched against the back of said paddle disk.

10. The water paddle as described in claim 7 wherein said adjustable strap can be adjusted in a third position on said paddle disk for allowing an upper portion of the swimmer's palm to rest along the centerline of said paddle disk.

11. A water paddle used on the hand of a swimmer for surface and underwater swimming, snorkeling, water aerobics and other water exercises, the water paddle comprising:

a round, hand held, lightweight, round, flexible plastic, hydrodynamic paddle disk, said paddle disk having a front and a back, the front of said disk is concave in shape and the back of said disk is convex in shape, said disk having a diameter sufficient for covering the hand and fingers of the swimmer, the back of the disk adapted for receiving a palm of the swimmer's hand; and an adjustable hand strap, said adjustable strap received through a length of a pair of parallel hand strap slots in said disk, the length of said parallel hand strap slots greater than a width of said adjustable hand strap so that said hand strap can be adjusted up and down on said paddle disk for allowing the swimmer to adjust his or her hand at more than one position on the back of paddle disk, said hand strap received over a back of the swimmer's hand, said hand strap having a width sufficient to cover a portion of the back of the swimmer's hand, a portion of said hand strap adapted for receipt in a "V" between the swimmer's thumb and index finger;

whereby said adjustable hand strap has a first side and a second side, the first side adapted for receipt of the hand in a first position on said disk, the first side disposed below a center line of said disk, the second side disposed along the center line of said disk, the first position allowing said disk to cover the hand and fingers of the swimmer;

whereby when said disk is rotated 180 degrees, said adjustable hand strap has the second side adapted for receipt on the hand in a second position on said disk, in the second position the first side is disposed above the center line of said disk and the second side disposed along the center line of said disk, the second position allowing the finger of the swimmer to grip an edge of an upper portion of said disk;

whereby said adjustable hand strap is adapted for receipt on the hand in a third position on said disk for allowing an upper portion of the swimmer's palm to rest along the centerline of said paddle disk.

12. The water paddle as described in claim 11 wherein said paddle disk has a diameter in a range of 4 to 12 inches.

13. The water paddle as described in claim 11 wherein said adjustable strap has a width in a range of ½ to 2 inches for comfort when the swimmer's hand is arched against the back of said paddle disk.

* * * * *